US005372542A

United States Patent [19]

Geib et al.

[11] Patent Number: 5,372,542

[45] Date of Patent: Dec. 13, 1994

[54] DISC COIN SORTER WITH IMPROVED EXIT CHANNEL

[75] Inventors: Joseph J. Geib, Des Plaines; Scott D. Casanova, Roselle; John P. Gibbons, Mt. Prospect; Douglas U. Mennie, Barrington, all of Ill.

[73] Assignee: Cummins-Allison Corp., Mt. Prospect, Ill.

[21] Appl. No.: 89,765

[22] Filed: Jul. 9, 1993

[51] Int. Cl.[5] ..... G07D 3/00

[52] U.S. Cl. ..... 453/10

[58] Field of Search ..... 453/6, 10

[56] References Cited

U.S. PATENT DOCUMENTS

| | | | |
|---|---|---|---|
| 4,086,928 | 5/1978 | Ristvedt . | |
| 4,098,280 | 6/1978 | Ristvedt . | |
| 4,506,685 | 3/1985 | Childers et al. . | |
| 4,543,969 | 10/1985 | Rasmussen | 453/10 |
| 4,549,561 | 10/1985 | Johnson et al. | 453/10 |
| 4,557,282 | 12/1985 | Childers et al. . | |
| 4,564,036 | 1/1986 | Ristvedt . | |
| 4,564,037 | 1/1986 | Childers et al. . | |
| 4,570,655 | 2/1986 | Raterman | 453/10 |
| 4,607,649 | 8/1986 | Taiple et al. | 453/6 |
| 4,681,128 | 7/1987 | Ristvedt et al. . | |
| 4,731,043 | 3/1988 | Ristvedt . | |
| 4,775,353 | 10/1988 | Childers et al. . | |
| 4,775,354 | 10/1988 | Rasmussen | 453/10 |
| 4,863,414 | 9/1989 | Ristvedt et al. . | |
| 4,921,463 | 5/1990 | Primdahl et al. . | |
| 4,966,570 | 10/1990 | Ristvedt et al. | 453/6 |
| 5,009,627 | 4/1991 | Rasmussen . | |
| 5,011,455 | 4/1991 | Rasmussen . | |
| 5,022,889 | 6/1991 | Ristvedt et al. . | |
| 5,026,320 | 6/1991 | Rasmussen . | |
| 5,106,338 | 4/1992 | Rasmussen et al. . | |
| 5,123,873 | 6/1992 | Rasmussen . | |
| 5,141,443 | 8/1992 | Rasmussen . | |
| 5,197,919 | 3/1993 | Geib et al. . | |

*Primary Examiner*—F. J. Bartuska

*Attorney, Agent, or Firm*—Arnold, White & Durkee

[57] ABSTRACT

A disc-type coin sorter for sorting coin mixtures which include at least one coin denominations of a range of thicknesses, the sorter has a rotatable disc having a resilient top surface, means for rotating the disc, a stationary sorting head having a lower surface positioned over and closely adjacent to the upper surface of the disc and having an opening in the central region thereof for feeding coins between the opposed surfaces of the disc and sorting head, the lower surface of the sorting head being contoured to align the coins in a single file and single layer of coins, and then sorting the coins according to their respective sizes, the contoured lower surface having at least one exit channel where the downstream guiding wall has a lower portion which is closer to the opposed, upstream wall of the channel than the upper portion of the downstream wall.

15 Claims, 6 Drawing Sheets

DISC COIN SORTER WITH IMPROVED EXIT CHANNEL

BACKGROUND OF THE INVENTION

1. Field of the Invention

The present invention relates generally to coin sorting devices and, more particularly, to coin sorters of the type which use a resilient rotating disc and a stationary sorting head for sorting coins of mixed diameters.

2. Background Information

Although disc-type coin sorters with resilient discs have been used for a number of years, problems are still encountered in applying this technology to certain types of coin sets. For example, in coin sets which includes coin denominations of widely varying thicknesses, when the thicker coins are pressed deeply into the surface of the resilient disc they create impressions in the surface of the disc. Such an impression also causes a depression of the area immediately surrounding the coin, resulting in immediately adjacent thinner coins to be positioned at a lower elevation than desired. The lower position causes the thinner coins to be spaced from, or only lightly pressed against, the lowermost surface of the contoured sorting head so that the thinner coins do not reliably follow the contour of the sorting head. For example, rather than engaging and following the downstream wall of the appropriate exit channel, a thin coin can dive under the desired guide wall and not be exited from the disc at the desired location. This will result in the missorting of coins.

Similar problems can occur with coins that are wedge-shaped, as a result of wear or mint errors. If the thin part of a wedge-shaped coin is at the downstream edge of the coin, the coin can pass under the guiding wall of its exit channel and cause a missort.

In addition to the specific problem discussed above, there is also an ongoing desire for ever-greater accuracy in the sorting of coins, particularly in disc-type sorters which operate at extremely high speeds.

SUMMARY OF THE INVENTION

It is a primary object of this invention to provide an improved disc-type coin sorter which can be operated at extremely high speeds and yet still achieve a high degree of accuracy.

One specific object of this invention is to provide an improved disc-type coin sorter which is capable of accurately processing coin sets in which the coins vary significantly in thickness.

Another specific object of the invention is to provide an improved disc-type coin sorter which can accurately and reliably sort wedge-shaped coins.

Other objects and advantages of the invention will be apparent from the following detailed description and the accompanying drawings.

In accordance with the present invention, the foregoing objectives are realized by providing a disc-type coin sorter which includes a rotatable disc having a resilient top surface, a drive motor for rotating the disc, and a stationary sorting head having a lower surface positioned parallel to the upper surface of the disc and spaced slightly therefrom, and the lower surface of the sorting head is contoured to have at least one exit channel with a downstream guiding wall having a lower portion which is closer to the opposed upstream wall of said channel than the upper portion of the downstream guiding wall. In one preferred embodiment, the downstream guiding wall of the exit channel is L-shaped to form a coin-guiding channel along the upper portion of the downstream wall of the exit channel. In another embodiment, the downstream wall of the exit channel is tapered, extending downwardly at an acute angle from the top surface of the exit channel. These wall configurations tend to retain the downstream edges of coins within the exit channel as the coins are exited through that channel.

DESCRIPTION OF THE PREFERRED EMBODIMENTS

Figure 1:
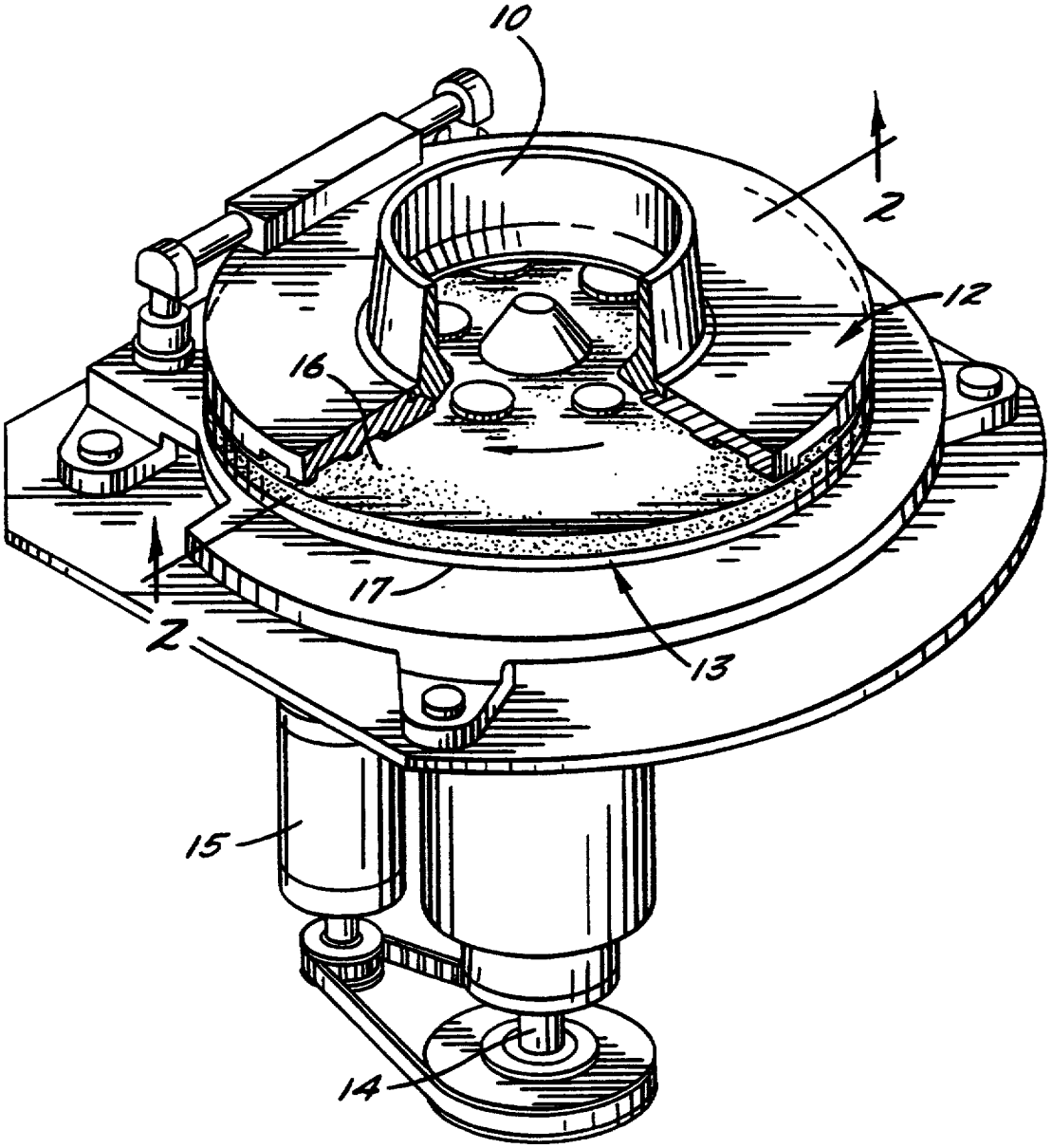
FIG. 1 is perspective view of a coin sorter embodying the present invention, with portions thereof broken away to show internal structure.

While the invention is susceptible to various modifications and alternative forms, specific embodiment thereof have been shown by way of example in the drawings and will be described in detail. It should be understood, however, that it is not intended to limit the invention to the particular forms described, but, on the contrary, the intention is to cover all modifications, equivalents, and alternatives falling within the spirit and scope of the invention as defined by the appended claims.

Turning now to the drawings and referring first to FIG. 1, a hopper 10 receives coins of mixed denominations and feeds them through a feed opening in an annular sorting head or guide plate 12. As the coins pass through the feed opening (not shown), they are deposited on the top surface of a rotatable disc 13. This disc 13 is mounted for rotation on a stub shaft 14 and driven by an electric motor 15 mounted to a base plate (not shown). The disc 13 comprises a resilient pad 16 bonded to the top surface of a rigid disc 17.

As the disc 13 is rotated, the coins deposited on the top surface thereof tend to slide outwardly over the surface of the pad due to centrifugal force. As the coins move outwardly, those coins which are lying flat on the pad enter the gap between the pad surface and the sorting head 12 because the underside of the inner periphery of this plate is spaced above the pad 16 by a distance which is approximately the same as the thickness of the thickest coin. As further described below, the coins are sorted into their respective denominations, and the coins for each denomination issue from a respective exit channel, such as the channels 20, 21, 22, 23, 24 and 25 (FIG. 2).

In general, the coins for any given currency are sorted by the variation in diameter of the various denominations. Prior to sorting, the coins are manipulated between the sorting head and the rotating disc to queue the coins into a single-file, single-layer stream of coins.

The outer edges of all the coins in this stream of coins are normally aligned to be tangent to a common line of travel so that the downstream edges of the coins can be engaged to discriminate among coins of different diameters, directing the coins to the exit slots for the respective denominations.

Figure 2:
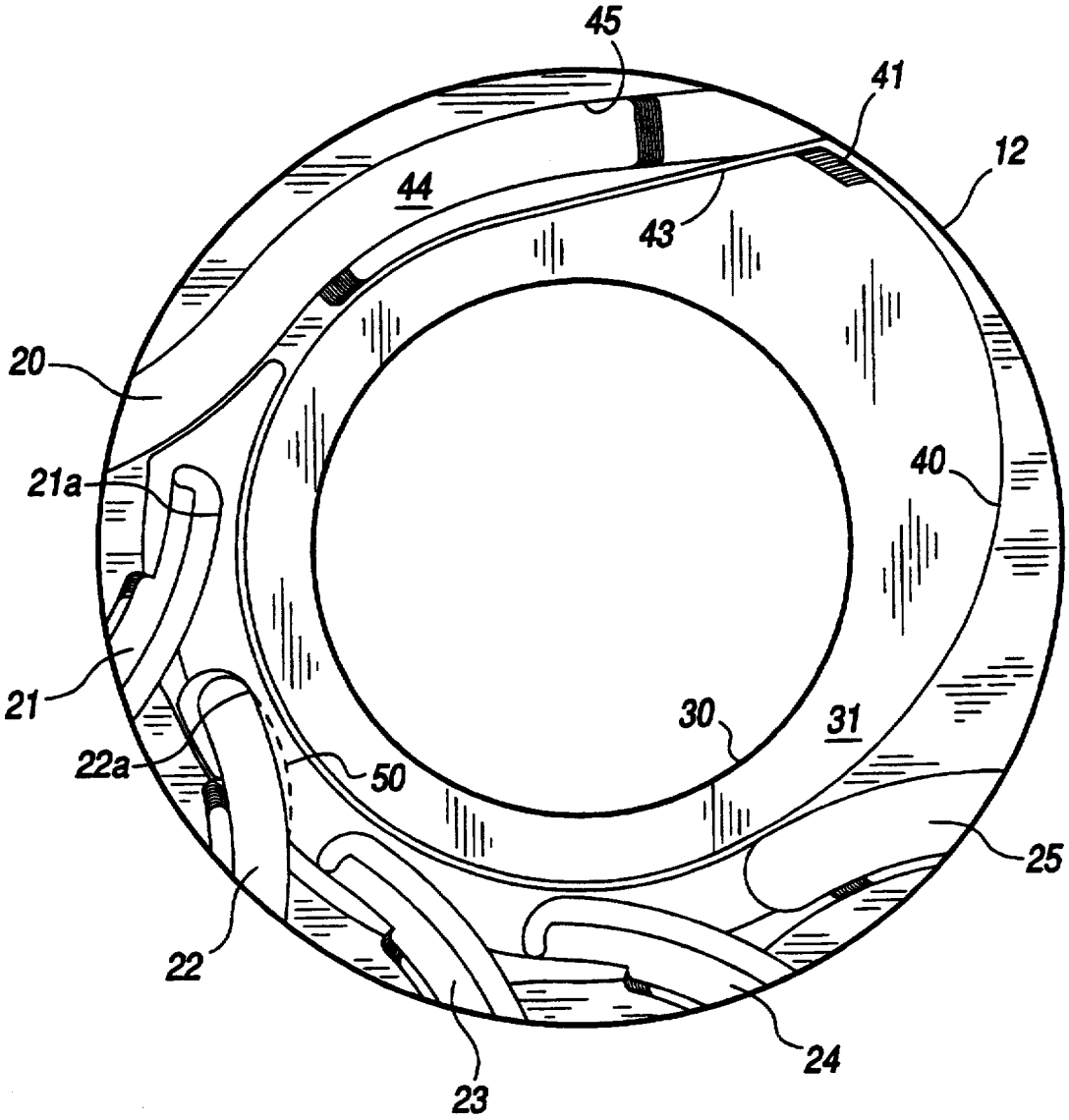
FIG. 2 is an enlarged bottom plan view of the sorting head or guide plate in the coin sorter of FIG. 1, taken generally along line 2—2 in FIG. 1.

Turning now to FIG. 2, there is shown a bottom view of the preferred sorting head 12 including various channels and other means especially designed for high-speed sorting with positive control of the coins. It should be kept in mind that the circulation of the coins, which is clockwise in FIG. 1, appears counterclockwise in FIG. 2 because FIG. 2 is a bottom view. The various regions that manipulate the coins include an entry region adjacent the inner periphery 30 of the sorting head, a queuing region which includes a spiral wall 40, and the exit channels 20–25 for different coin denominations.

Considering first the entry region, the coins deposited on the rotating disc 13 directly beneath the feed opening 11 are carried under the inner periphery 30 of the sorting heard into an annular recess 31 adjacent the inner periphery 30. Coins can move radially into the recess 31, which is spaced above the top surface of the pad 16 by a distance which is about the same as the thickness of the thickest denomination of coin.

Radial outward movement of coins within the recess 31 is terminated when they engage the outer wall 40, though the coins continue to be moved circumferentially along the wall 40 by the rotational movement of the disc 13. The outer wall 40 of the recess 31 extends downward to the lowermost surface of the sorting head 12, which is preferably spaced from the top surface of the pad 16 by a distance, e.g., 0.005 inch, which is less than the thickness of the thinnest coin. Consequently, free radial movement of the coins is terminated when they engage outer wall 40, though the coins continue to move circumferentially along the wall 40 by the rotational movement of the pad.

At the end of the spiral wall 40, i.e., at the point where the spiral wall reaches its maximum radius, the coins engage a ramp 41 which presses the coins downwardly into the resilient surface of the rotating disc. The outer edges of coins which are against the outer wall 40 have a common radial position and are ready for sorting. Coins whose radially outer edges are not engaged by the ramp 41 engage a wall 43 which guides such coins back into the entry recess 31 for recirculation.

It can occur that correctly aligned coins passing under the recycling wall 43 can be slightly shifted in their radial position. To correct this, coins which pass the recycling wall 43 enter a gaging channel 44 which allows the coins to be realigned against a radially outer wall 45. The channel 44 and wall 45 allow the coins in the sorting path an opportunity to realign their outer edges at the radial position required for correct sorting.

The sorting head 12 forms the series of exit channels 20–25 spaced circumferentially around the outer periphery of the sorting head. The inboard end of the downstream wall of each successive exit channel is located progressively farther away from the common radial location of the outer edges of all the coins for receiving and ejecting coins in order of increasing diameter. Because the outer edges of all coins are located at the same radial position, coins of the smallest diameter will be the only ones to be captured by the downstream wall of the first exit channel. Coins of larger diameter extend inwardly beyond the inboard end of the downstream wall of the first exit channel, thereby preventing those coins from being captured in that particular channel. The larger diameter coins will pass a series of progressively larger exit channels until engaged by an exit channel whose downstream wall extends inwardly far enough to engage the coin. The exit channels extend outwardly to the periphery of the sorting head so that the downstream walls of the exit channels guide the coins outwardly and eventually eject those coins from between the sorting head 12 and the resilient pad 16.

In the illustrative coin sorter, the exit channel 21 is intended to discharge only 0.75-inch-diameter coins, and thus the downstream edge **21*a* of this channel is located at a radius that is spaced inwardly from the final radius of the gaging wall 45 by a distance that is only slightly greater than 0.75 inch. Consequently, only the 0.75 -inch-diameter coins can enter the channel 21. Because the outer edges of all denominations of coins are located at the same radial position when they leave the galling channel 44, the downstream edges of all denominations larger than the 0.75 -inch-diameter coin extend inwardly beyond the downstream edge of the exit channel 21**, thereby preventing these coins from entering the first exit channel.

At exit channel 22, the downstream edges of only 0.800-inch-diameter coins are located close enough to the periphery of the sorting head 12 to enter the exit channel. The downstream edges of all the larger coins extend inwardly beyond the downstream edge **22*a* of the channel 22 so that they remain gripped between the sorting head 12 and the resilient pad 16. Consequently, all the coins except the 0.800-inch-diameter coins continue to be rotated past the exit channel 22**.

Similarly, only 0.820-inch-diameter coins enter the channel 23, only 0.860-inch-diameter coins enter the channel 24, and only 0.920-inch-diameter coins enter the channel 25. The entire coin set has a thickness range of 0.060 to 0.072 inch.

Missorting can occur in the region of the exit channels 20–25 when a relatively thin coin is immediately adjacent a relatively thick coin. The lands between the exit channels are part of the lowermost surface of the sorting head, which is only slightly above the surface of the resilient pad. Thus, when a large-diameter thick coin is traversing the exit channels, the surfaces between the exit channels, or the lands, press virtually the entire thickness of the coin into the resilient pad, producing a deep impression in the pad, which surrounds the thick coin. Consequently, if a thin coin is immediately adjacent to a thick coin, the thin coin is in the surrounding impression created by the thick coin, thereby lowering the elevation of the thin coin sufficiently that the coin is not firmly held between the sorting head and the pad. Such a coin may pass beneath the guiding wall of its exit channel, resulting in a missort. Of course, such missorts are even more likely to occur when the thin coin is a worn coin having rounded edges. The occurrence of such missorts is also more likely in the case of a pad which has aged to the point where it has lost part of its resilience and a thick coin therefore creates an even larger surrounding impression. As described previously, similar missorting can occur with wedge-shaped coins.

In accordance with the present invention, the retention of coins in their exit channels is enhanced by providing the exit channels with a downstream wall which is configured so that the lower portion of the wall is closer to the opposed, upstream wall of the channel than the upper portion of the downstream wall. This wall configuration positively retains the downstream edge of the coin against the upper portion of the guiding wall of the exit channel, making it difficult for the coin to drop clown and escape from its exit channel by diving under the wall of the channel.

Figure 3:
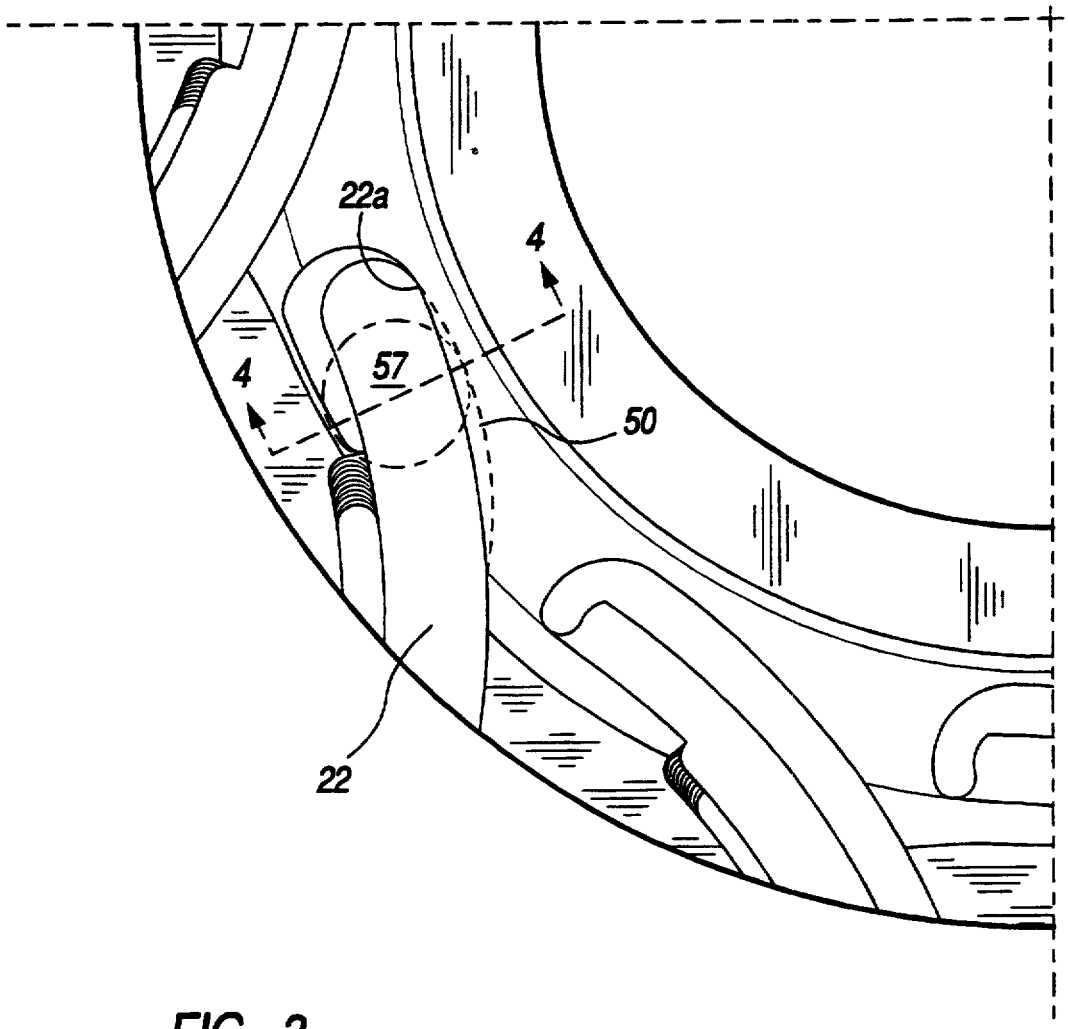
FIG. 3 is an enlargement of the lower left-hand portion of FIG. 2.
Figure 4:
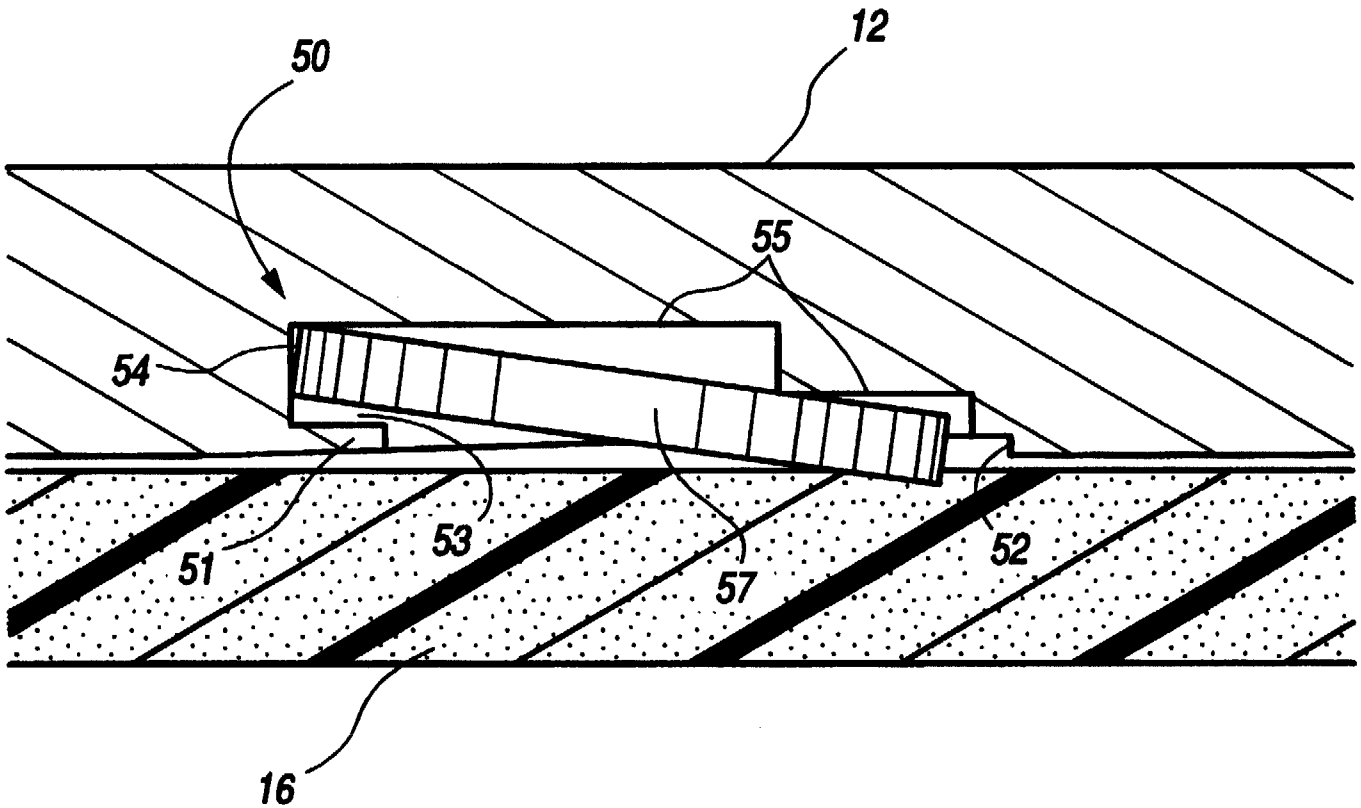
FIG. 4 is an enlarged section taken generally along line 4—4 of FIG. 3.

In the particular embodiment illustrated in FIGS. 2–4, the downstream wall 50 of the exit channel 22 is provided with an L-shaped configuration so as to form a flange 51 on the lower portion of the wall. This flange 51 extends toward the opposed upstream wall 52 of the channel. Thus, a channel 53 is formed along the upper portion of the wall 50 for receiving and positively retaining the downstream edge 54 of any coin that enters the exit channel 22. As a coin 57 enters the exit channel 22, the stepped upper surface 55 of the exit channel presses the upstream edge 56 of the coin into the resilient pad, thereby tilting the downstream edge 54 of the coin 57 upwardly into the exit channel 22, as illustrated in FIG. 4. The upward angulation of the coin 57 ensures that the downstream edge 54 of the coin is captured in the channel 53 in the wall 50 of the exit channel 22. As the exit channel 22 extends outwardly toward the periphery of the sorting head, the downstream edge 54 of the coin 57 will be positively retained in the channel 53 even if the elevation of the pad surface supporting the coin is lowered due to a depression in the pad.

As can be seen in FIGS. 2 and 3, the horizontal depth of the channel 53 gradually increases and then diminishes to zero before the outer end of the exit channel is reached. This arcuate configuration of the channel 53 allows the coin 57 to follow the coin-guiding walls on the upstream side of the exit channel.

Although the uppermost surface of the coin 57 is pressed upwardly against the upper surface 55 throughout the entire length of the exit channel 22, by the pressure of the pad 16, the channel 53 is also useful in sorters in which the coins are not pressed against the upper surfaces of the exit channels. Also, the thickness of the flange 51 may vary along the length of the exit channel to vary the pressure on the coin.

Figure 5:
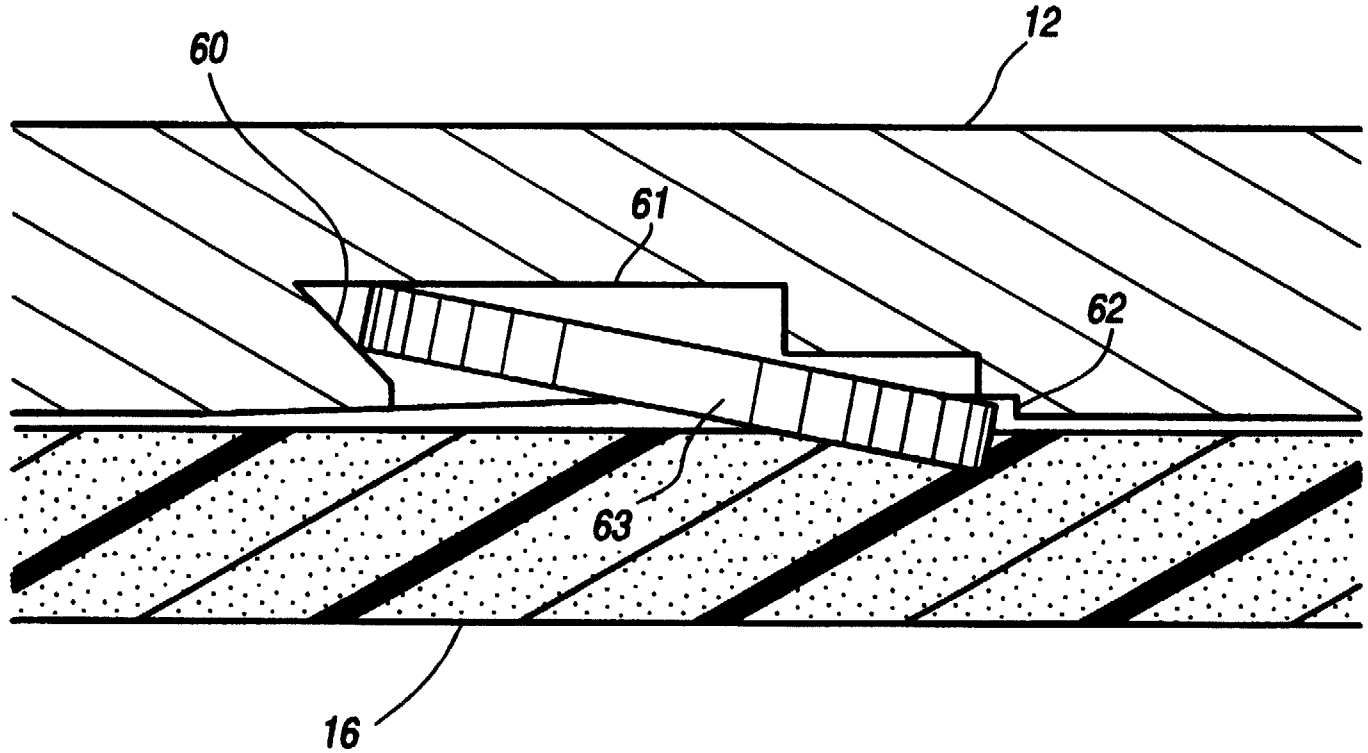
FIG. 5 is a sectional view similar to FIG. 4 but showing a modified embodiment of the invention.

A modified wall configuration is illustrated in FIG. 5. In this modified embodiment, the downstream wall 60 of the exit channel 21 forms an acute angle, rather than a right angle, with the upper surface 61 of the exit channel. The wall 60 thus tapers downwardly and inwardly toward the opposed, upstream channel wall 62. Consequently, the wall 60 tends to trap the downstream edge of a coin 63 against the upper portion of the guiding wall 60, as illustrated in FIG. 5.

Figure 6:
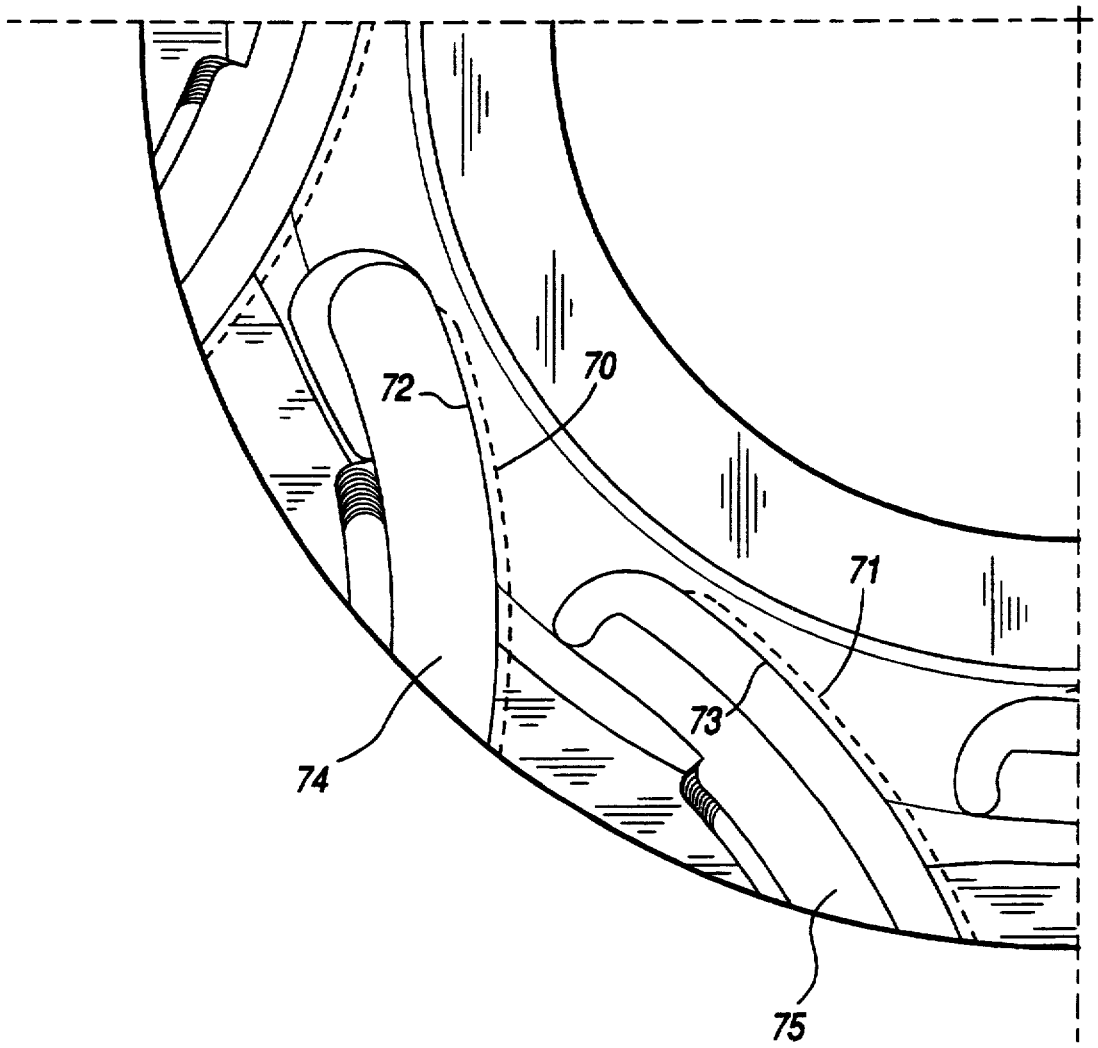
FIG. 6 is a bottom plan view of a pair of exit channels in a modified sorting head embodying the present invention.

In another modified embodiment illustrated in FIG. 6, the coin-retaining channel extends along the full length of the downstream wall of the exit channel, and has a uniform horizontal depth. Thus, channels or grooves 70 and 71 are formed in the downstream walls 72 and 73 of the exit channels 74 and 75.

The benefits of the present invention, which can be used to improve the sorting of any set of coins, is particularly evident in a sorting head which processes coin sets in which the thickest coin is at least 40% thicker than the thinnest coin. An example is the case of Eisenhower dollars or the larger denomination tokens used in casino gaming operations with thicknesses greater than 0.100 inch, along with coins of common denomination, such as quarters, which are less than 0.070 inch in thickness. When processing coins at a high rate of speed, the relatively thick Eisenhower dollar coin, 0.105 inch in thickness, and some extremely thick casino tokens, which exceed the thickness of the Eisenhower dollar, create impressions deep enough to cause thin adjacent coins such as a quarter, 0.067 inch in thickness, to be unreliably sorted.

We claim:

1. A disc-type coin sorter for sorting coin mixtures which include coins of mixed diameters, said sorter comprising:

a rotatable disc having a resilient top surface, a stationary sorting head having a lower surface positioned parallel to the upper surface of said disc and spaced slightly therefrom, the lower surface of said sorting head forming a plurality of exit channels for guiding coins of different diameters to different exit stations along the periphery of the sorting head, the exit channel having a downstream guiding wall and an opposed upstream wall, the downstream guiding wall having a lower and an upper portion, the lower portion being closer to the rotatable disc than the upper portion, and the lower portion of the downstream guiding wall of at least one of said exit channels is arranged and constructed to be closer to the opposed upstream wall than the upper portion.

2. The coin sorter of claim I where the lower portion of said downstream guiding wall is closer to the opposed upstream wall than the upper portion along the entire length of said downstream guiding wall.

3. The coin sorter of claim 1 where the lower portion of said downstream guiding wall is closer to the opposed upstream wall than the upper portion for only a portion of the length of said downstream guiding wall.

4. The coin sorter of claim 1 wherein said lower portion of said downstream guiding wall includes a flange, said flange extends toward the opposed upstream wall of said channel so as to form a coin-receiving channel along the upper portion of said downstream guiding wall.

5. The coin sorter of claim 1 wherein said downstream guiding wall extends downward at an acute angle from the lower surface of the sorting head.

6. The coin sorter of claim 1 wherein the lower surface of the sorting head adjacent the upstream wall of said at least one exit channel is contoured to press the upstream portion of the coins into the resilient pad so that the downstream edges of the coins received by said at least one exit channel are angled upward into said at least one exit channel.

7. The coin sorter of claim 6 where the upstream wall has a lower and upper portion, the lower portion being closer to the rotatable disc than the upper portion, where the upper portion of the upstream wall is closer to the opposed downstream guiding wall than the lower portion of the upstream wall to form a contour in the lower surface of the sorting head which presses the upstream portion of coins into the resilient pad so that the downstream edges of the coins received by said at least one exit channel are angled upward into the exit channel.

8. A coin sorting head for sorting coin mixtures which include coins of mixed diameters, said head comprising:

a lower surface positioned parallel to the upper surface of said disc and spaced slightly therefrom, the lower surface of said sorting head forming a plurality of exit channels for guiding coins of different diameters to different exit stations around the periphery of the sorting head, the exit channel having a downstream guiding wall and an opposed upstream wall, the downstream guiding wall having a lower and an upper portion, the lower portion being closer to the rotatable disc than the upper portion, and the lower portion of the downstream guiding wall of at least one of said exit channels is arranged and constructed to be closer to the opposed upstream wall than the upper portion.

9. The coin sorting head of claim 8 where the lower portion of said downstream guiding wall is closer to the opposed upstream wall than the upper portion along the entire length of said downstream guiding wall.

10. The coin sorting head of claim 8 where the lower portion of said downstream guiding wall is closer to the opposed upstream wall than the upper portion for only a portion of the length of said downstream guiding wall.

11. The coin sorting head of claim 8 wherein said lower portion of said downstream guiding wall includes a flange, said flange extends toward the opposed upstream wall of said channel so as to form a coin-receiving channel along the upper portion of said downstream guiding wall.

12. The coin sorting head of claim 8 wherein said downstream guiding wall extends downward at an acute angle from the lower surface of the sorting head.

13. The coin sorting head of claim 8 wherein the lower surface of the sorting head adjacent the upstream wall of said at least one exit channel is contoured to press the upstream portion of the coins into the resilient pad so that the downstream edges of the coins received by said at least one exit channel are angled upward into said at least one exit channel.

14. The coin sorting head of claim 13 where the upstream wall has a lower and upper portion, the lower portion being closer to the rotatable disc than the upper portion, where the upper portion of the upstream wall is closer to the opposed downstream guiding wall than the lower portion of the upstream wall to form a contour in the lower surface of the sorting head which presses the upstream portion of coins into the resilient pad so that the downstream edges of the coins received by said at least one exit channel are angled upward into the exit channel.

15. A method of controlling the movement of coins between a stationary sorting head and a rotatable disc having a resilient upper surface located beneath said sorting head and close enough to the lowermost surface of the head to cause those surfaces to press the coins into said resilient surface, said method comprising the steps of:

guiding coins of different diameters through different exit channels leading to the periphery of the disc, providing at least one of said exit channels having a lower and an upper portion, the lower portion being closer the rotatable disc than the upper portion, and using the sorting head, pressing the upstream edges of the coins firmly into the resilient pad so that the downstream edges of the coins are angled upward into the exit channel to be secured by a downstream guiding wall having a lower portion being closer to the opposed upstream wall than the upper portion.

* * * * *